US007209120B2

(12) United States Patent
Oguro

(10) Patent No.: US 7,209,120 B2
(45) **Date of Patent: *Apr. 24, 2007**

(54) INPUT DEVICE AND INFORMATION PROCESSING APPARATUS

(75) Inventor: Masaki Oguro, Tokyo (JP)

(73) Assignee: Sony Corporation, Tokyo (JP)

( * ) Notice: Subject to any disclaimer, the term of this patent is extended or adjusted under 35 U.S.C. 154(b) by 67 days.

This patent is subject to a terminal disclaimer.

(21) Appl. No.: 11/078,412

(22) Filed: Mar. 14, 2005

(65) Prior Publication Data

US 2005/0162386 A1 Jul. 28, 2005

Related U.S. Application Data

(63) Continuation of application No. 09/664,482, filed on Sep. 18, 2000, now Pat. No. 6,888,533.

(30) Foreign Application Priority Data

Sep. 20, 1999 (JP) ..... 11-265679

(51) Int. Cl.
*G09G 5/08* (2006.01)

(52) U.S. Cl. ..... 345/161; 345/156; 345/167

(58) Field of Classification Search ..... 345/156–157, 345/161–163, 167–169; 200/6 A, 6 R
See application file for complete search history.

(56) References Cited

U.S. PATENT DOCUMENTS 4,879,556 A 11/1989 Duimel
5,515,044 A 5/1996 Glatt
5,546,334 A 8/1996 Hsieh et al.
5,625,381 A 4/1997 Wyss
5,633,658 A 5/1997 Ma
5,652,630 A 7/1997 Bertram et al.
5,657,051 A 8/1997 Liao
5,793,355 A 8/1998 Youens
6,040,539 A 3/2000 Hiegel
6,059,660 A 5/2000 Takada et al.
6,099,929 A 8/2000 Chinen
6,359,611 B2 3/2002 Chan (Continued)

FOREIGN PATENT DOCUMENTS

EP 0 867 212 9/1998

(Continued)

OTHER PUBLICATIONS

U.S. Appl. No. 11/071,222, filed Mar. 4, 2005, Oguro.

(Continued)

*Primary Examiner*—Regina Liang
(74) *Attorney, Agent, or Firm*—Oblon, Spivak, McClelland, Maier & Neustadt, P.C.

(57) ABSTRACT

The invention provides an input device which includes a gripping part, a pointing part, and at least one depressible part furnished in such a manner that while holding the gripping part by hand, a user may manipulate the pointing and depressible parts with fingertips to perform the same kinds of operations as those of a mouse. The input device may include a rotating and/or a pivoting part and at least one operating element which provide a still wider variety of functions when operated.

1 Claim, 4 Drawing Sheets

U.S. PATENT DOCUMENTS 6,429,852 B1 8/2002 Adams et al.
6,822,638 B2 11/2004 Dobies et al.

FOREIGN PATENT DOCUMENTS

EP 0 938 227 A2 8/1999
GB 2 266 759 11/1993
WO 99/42919 8/1999

OTHER PUBLICATIONS

U.S. Appl. No. 11/078,413, filed Mar. 14, 2005, Oguro.
U.S. Appl. No. 11/078,406, filed Mar. 14, 2005, Oguro.
U.S. Appl. No. 11/078,437, filed Mar. 14, 2005, Oguro.
U.S. Appl. No. 11/078,412, filed Mar. 14, 2005, Oguro.
U.S. Appl. No. 11/078,438, filed Mar. 14, 2005, Oguro.

INPUT DEVICE AND INFORMATION PROCESSING APPARATUS

CROSS-REFERENCE TO RELATED APPLICATIONS

This application is a continuation of U.S. application Ser. No. 09/664,482 filed Sep. 18, 2000 now U.S. Pat. No. 6,888,533, and further is based upon and claims the benefit of priority from the prior Japanese Patent Application No. 11-265679, filed Sep. 20, 1999, the entire contents of each of which are incorporated herein by reference.

BACKGROUND OF THE INVENTION

The present invention relates to an input device and an information processing apparatus.

Information processing apparatuses including computers and varieties of electronic appliances like audio visual equipment are generally operated by use of input instruments such as a mouse and a keyboard.

The mouse is a handy pointing device that has been frequently used in connection with computers. However, a need has been recognized increasingly to replace the mouse with something easier to operate and more convenient to use, given the ever-advancing functionality of information processing apparatuses, growing trends toward combining data processors with their peripheral devices into viable system configurations, and users' widening scope of purposes to which such equipment has been applied.

SUMMARY OF THE INVENTION

The present invention has been made in view of the above circumstances and provides an input device that is easy to use and capable of executing diverse kinds of input.

In carrying out the invention and according to one aspect of thereof, there is provided an input device in an enclosure including a gripping part to be gripped by a user's hand, and a pointing part so located as to be operable by any of said user's fingers while said user's hand is holding said gripping part. Operating the pointing part allows the user to perform the same kinds of operation as those with a mouse that is moved by the user's gripping hand.

In one preferred structure according to the invention, the input device may further include either one or a plurality of depressing parts so located as to be operable by fingers of the user while the user's hand is holding the gripping part. The depressing parts when operated permit the same types of operation as those with the mouse buttons that are clicked on by the user's gripping hand.

In another preferred structure according to the invention, the pointing part may be at least tiltable crosswise and lengthwise. These motions of the pointing part provide a sufficiently wide range of pointing input functions. When made depressible, the pointing part provides additional operating functions.

In a further preferred structure according to the invention, the input device may further include a rotating part and/or a pivoting part furnished on top of the gripping part. These parts offer a more extensive variety of input operations when manipulated.

In an even further preferred structure according to the invention, the input device may further include either one or a plurality of operating parts so located as to be inaccessible by the user's fingers while the user's hand is holding the gripping part.

In a still further preferred structure according to the invention, the input device may further include a sheet member which is mountable onto an upper surface of the input device and which bears either pictorial patterns or characters as desired.

In a yet further preferred structure according to the invention, the input device may further include a sheet member which is mountable onto the upper surface of the input device and which is either transparent or translucent.

According to another aspect of the invention, there is provided an information processing apparatus including inputting means in an enclosure having a gripping part to be gripped by a user's hand, and a pointing part so located as to be operable by any of the user's fingers while the user's hand is holding the gripping part; and information processing means for processing information suitably in response to operating information which is input by operation of the pointing part included in the inputting means.

Other objects, features and advantages of the present invention will become apparent in the following specification and accompanying drawings.

DETAILED DESCRIPTION OF THE PREFERRED EMBODIMENTS

Preferred embodiments of this invention will now be described with reference to the accompanying drawings.

Figure 1:
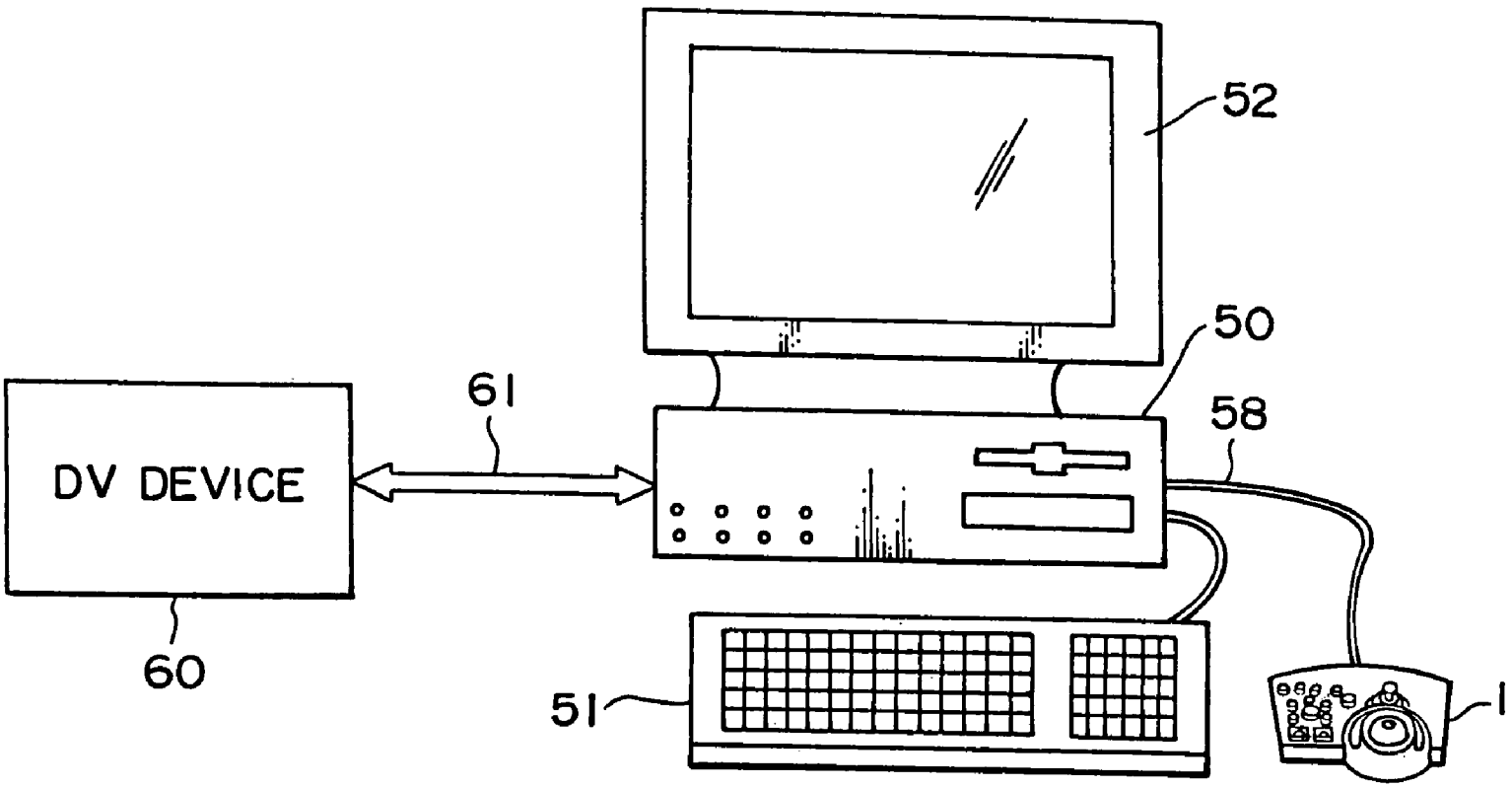
FIG. 1 is an explanatory view of a system configuration comprising a personal computer and an input device both embodying the invention.

FIG. 1 shows a typical system configuration including a personal computer 50 as an information processing apparatus embodying the invention, and an input device 1 also embodying the invention.

The personal computer 50 has its body connected to a monitor display 52, a keyboard 51 and others.

In this setup, the input device 1 is provided as another inputting means in addition to the keyboard 51. The input device 1 may illustratively be connected to the personal computer 50 by use of a USB (Universal Serial Bus) cable 53.

The input device 1 is placed on a desk top or in like location along with the keyboard 51.

The input device 1 is capable of making inputs instructing the personal computer 50 to carry out various processes. As such, the input device 1 is at least as efficient as a conventional mouse in designating operations to be performed. Depending on the OS (Operating System) of the personal computer 50 or application software already started up and running, the input device 1 is set to provide diverse input operation functions.

FIG. 1 shows a DV (digital video) device 60 connected to the personal computer 50 illustratively by means of a DV cable. When connected to the DV device 60, the personal computer 50 may capture video data from the device and edit images and other data elements. Such editing work is also carried out by use of the input device 1.

Figure 2:
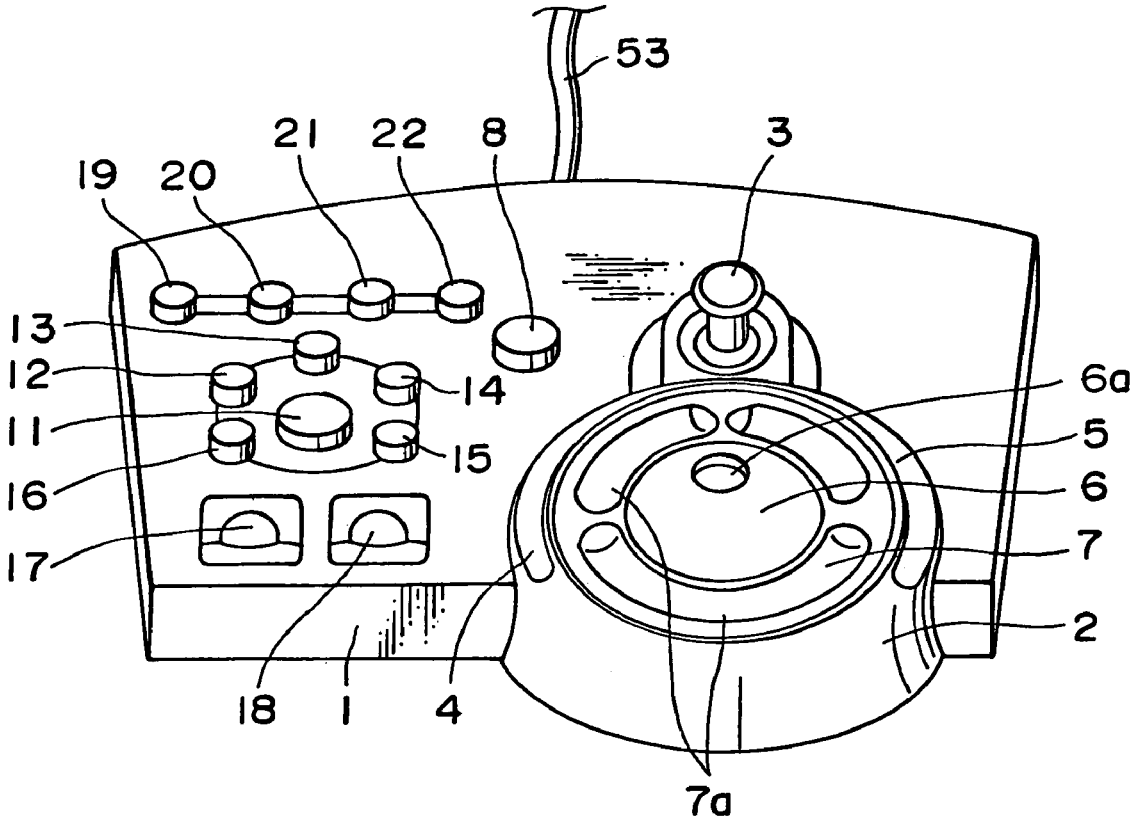
FIG. 2 is a perspective view of the input device according to the invention.

FIG. 2 gives an external view of the input device 1. Part of the input device 1 ranging from the front right-hand side to the upper part is equipped with a gripping part 2 that is approximately cylindrical in shape and formed in an elevated fashion.

Figure 3:
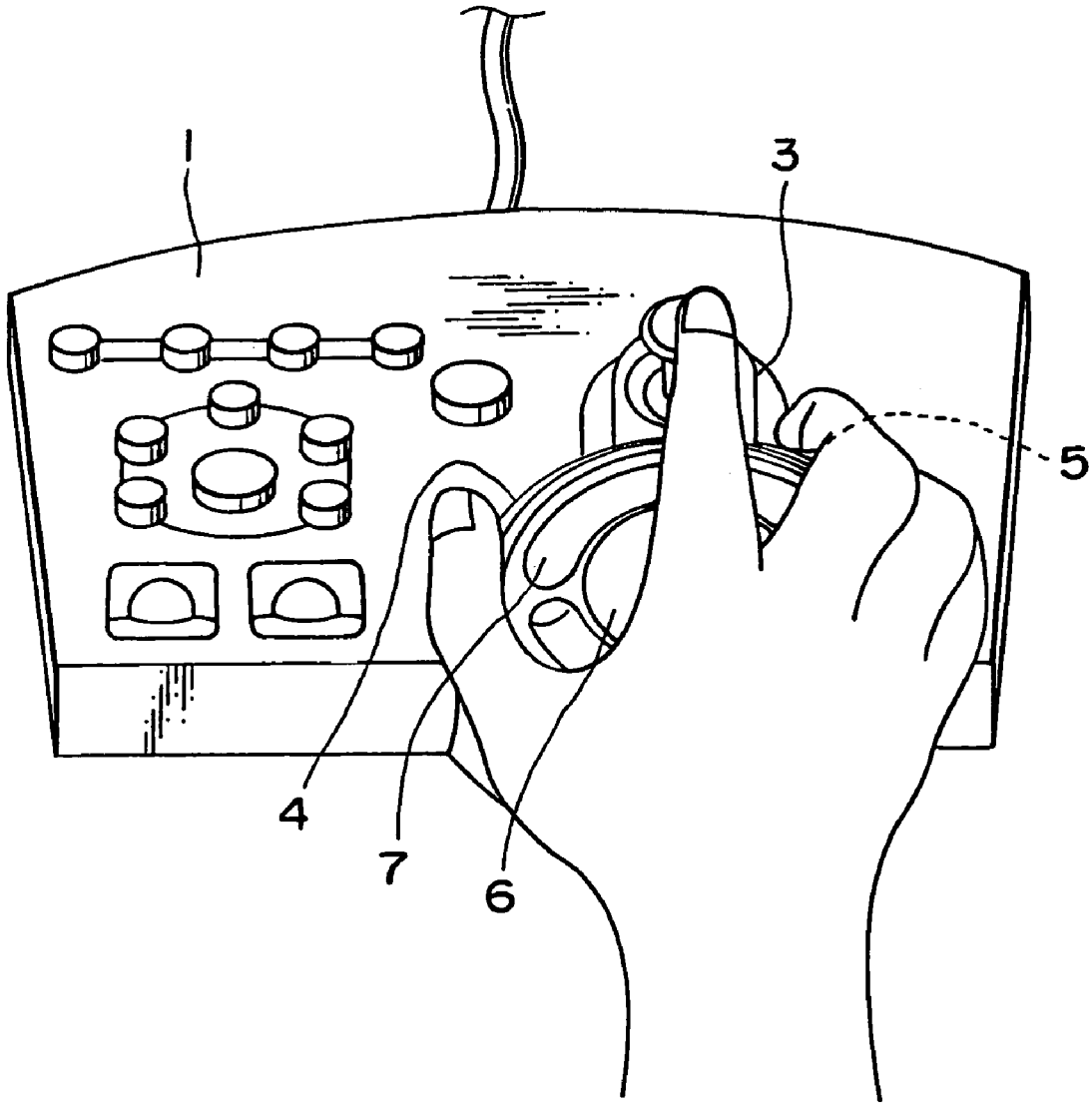
FIG. 3 is an explanatory view showing how the inventive input device is illustratively operated.

The gripping part 2, as shown in FIG. 3, is shaped and sized in such a manner as to be held snugly by a user's hand.

A stick-type pointer 3 is located toward the back of the device as seen from the gripping part 2.

The pointer 3 is designed to be tiltable at least crosswise and lengthwise. In practice, the pointer 3 is typically fabricated so as to tilted in the 360-degree directions.

In the back of the gripping part 2 are a left button 4 and a right button 5.

The left button 4 and the right button 5 are operating elements equivalent to the left and right click buttons of an ordinary mouse, respectively.

On top of the gripping part 2 is a jog key 6 that may be rotated freely clockwise and counterclockwise. The top of the jog key 6 has a local depression 6*a*. Putting his or her finger in the depression 6*a*, the user may rotate the jog key 6 in any direction by as many turns as desired.

Around the jog key 6 is a ring-shaped shuttle key 7. The shuttle key 7 is pivotally operated within a predetermined range of angles (e.g., ±45 degrees) clockwise and counterclockwise. The top of the shuttle key 7 has grooves 7*a* in which the user may put his or her finger to revolve the key 7. An internal mechanism, not shown, actuates the shuttle key 7 so that when released by the user, the key 7 returns to its home position (zero-degree position).

In the left corner of the upper surface of the input device 1, i.e., in locations inaccessible by the user's hand while the gripping part 2 is held thereby, there are a shift key 8 and operation keys 11 through 22 to which various operative functions are assigned.

The operation keys 11 through 22 each offer different functions depending on whether the shift key 8 is depressed or released. This means that the 12 operation keys 11 through 22, used in combination with the shift key 8, provide a total of 24 operative functions.

Operative information from any of the above-described operating elements (pointer 3, left button 4, right button 5, jog key 6, shuttle key 7, shift key 8, operation keys 11 through 22) is transmitted to the personal computer 50 through the USB cable 53. The personal computer 50 carries out processes in accordance with the received operative information.

As depicted in FIG. 3, the user holds the gripping part 2 by hand to operate the input device 1 in the same manner as the mouse.

With the user's hand holding the gripping part 2, the index finger may illustratively be on the pointer 3. The pointer 3 may then be tilted in desired directions by the fingertip.

Also with the gripping part 2 gripped by the user's hand, the thumb may be on the left button 4 and the middle finger on the right button 5.

While holding the gripping part 2 by hand, the user may thus operate the pointer 3 to carry out the same kinds of operation as those with a mouse moved on the desk top or the like. Operating the left button 4 or the right button 5 provides a left-button click or a right-button click of the mouse respectively.

That is, the user can perform exactly the same types of operation holding the gripping part 2 as those with the mouse. Unlike the mouse, the input device 1 obviously need not be moved on the desk top. This feature of the input device 1 provides distinct benefits: it is simpler to operate than a mouse, and it requires no space over which to move about.

The jog key 6 and shuttle key 7 are furnished on top of the gripping part 2 of the input device 1. Given the fact that the user usually keeps his or her hand on the gripping part 2, transition to operations of the jog key 6 and shuttle key 7 is natural and easy to accomplish.

With their counterparts already adopted extensively by audio visual equipment, the jog key 6 and shuttle key 7 permit various convenient functions: illustratively, fast forward and rewind of images and sound by the shuttle key 7, and frame-by-frame viewing of images by the jog key 6.

On the input device 1, the jog key 6 and shuttle key 7 are thus used illustratively to perform fast forward and frame-by-frame viewing of image data taken from the DV device 60 into the personal computer 50.

With its operative functions established as described, the input device 1 serves as an easy-to-control input device for such uses as editing of images.

It should be noted in particular that the user need only shift, bend, or stretch his or her fingers in very limited movements to operate the jog key 6, shuttle key 7, pointer 3, left button 4 and right button 5. Such finger motions put little burden on the user when carrying out mouse-like operations by the pointer 3, left button 4 and right button 5 in a seamlessly concurrent manner with manipulations by the jog key 6 and shuttle key 7.

The mouse-like operations, when thus combined with the easy manipulations of the jog key 6 and shuttle key 7, simplify and facilitate proceedings that would otherwise be complex and sophisticated.

Obviously, the jog key 6 and shuttle key 7 are not limited in their use to fast forward and frame-by-frame viewing of image data; they are also used for various operations such as scrolling, demarcation of a specific range to be processed, page feed, and value updates illustratively in a word-processing or spread sheet program being run on the personal computer 50. These functions, combined seamlessly with mouse-type actions, offer input device operability with high efficiency.

In recent years, a certain type of mouse has been equipped on their top with a dial-like operating element. The jog key 6 or shuttle key 7 can take over the function of the dial-like mouse-top operating element, thereby offering the user the same degree of ease of operation as that type of mouse in a simpler fashion.

With this input device 1 embodying the invention, the user may let go of the gripping part 2 (or by using the other hand) to operate the shift key 8 and operation keys 11 through 22. This mode of action permits execution of more diverse operations than before.

Needless to say, operating functions (i.e., operative details to be accomplished) assigned to the operating elements of the input device 1 differ depending on the host apparatus (personal computer, etc.) to which the input device is connected, on the OS of the host apparatus, or on the application software currently activated.

With this input device 1, as described, mouse-like operations are performed concurrently with manipulations by the jog key 6 and shuttle key 7 while the user is keeping his or her hand on the gripping part 2 (or in a situation close to it). That feature, combined with more operation keys 11 through 12 for additional uses, allows the input device 1 to address diverse kinds of apparatuses and applications each in an efficient manner.

Figure 4A:
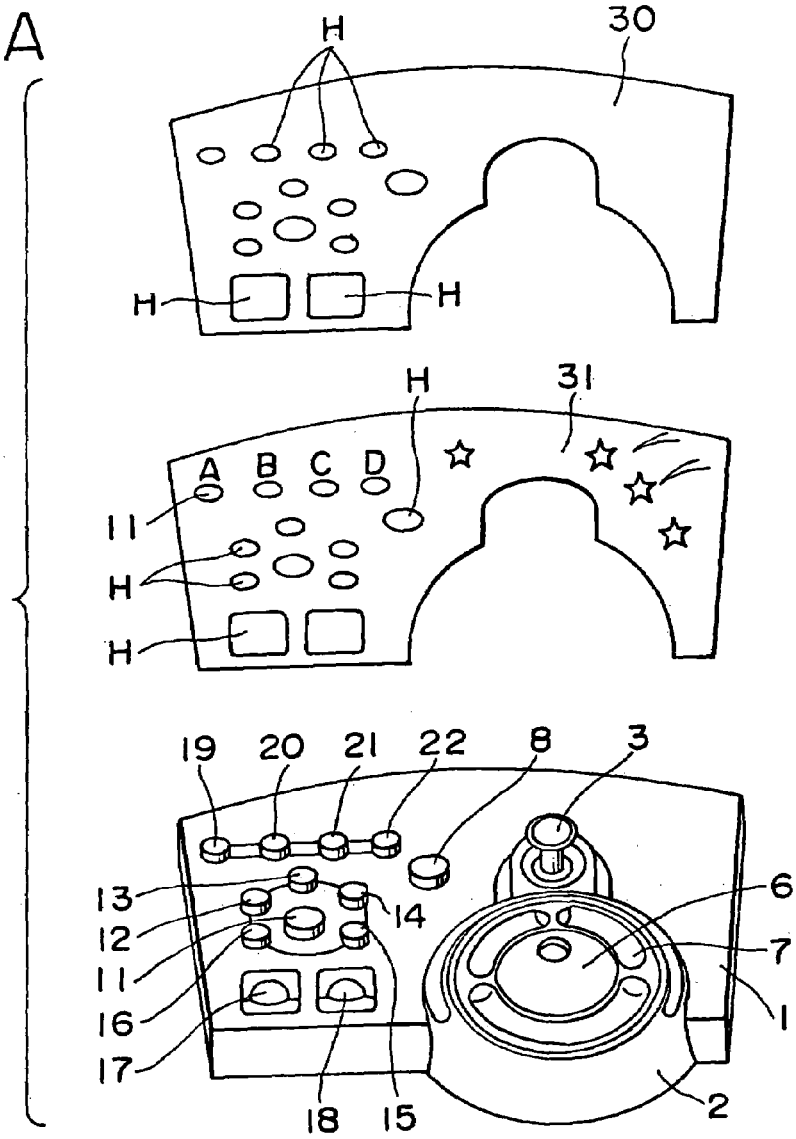
FIGS. 4A and 4B are explanatory views of sheets that may be mounted on the inventive input device.
Figure 4B:
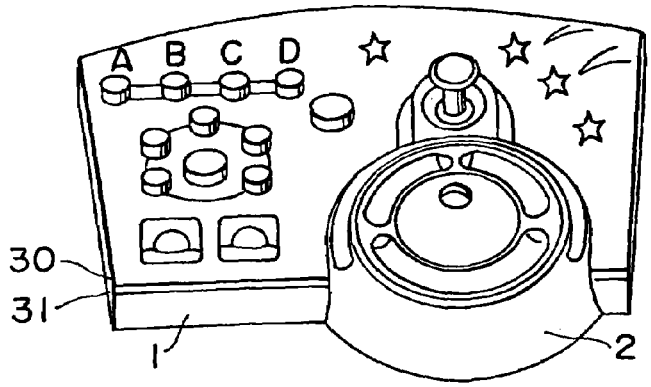

In addition to its ease and varieties of operation, the input device 1 may come with a transparent sheet 30 or a design sheet 31 furnished as shown in FIGS. 4A and 4B for better operability, for enhanced appearance, or simply for a playful motive.

The transparent sheet 30 and design sheet 31 depicted in FIG. 4A are each shaped so as to be mounted onto an upper surface of the input device 1.

More specifically, the transparent sheet 30 and design sheet 31 are formed so as to be attached snugly onto the upper surface of the input device 1 by including a cutout to make room for the gripping part 2 and pointer 3. By the same token, the sheets have holes H corresponding to the positions of the shift key 8 and operation keys 11 through 22, each hole being so shaped and sized as to accommodate the corresponding key.

The transparent sheet 30 may be constituted by a colorless, untinted plastic sheet. Alternatively, the sheet 30 may be any one of a colorless translucent sheet, a colored transparent sheet and a colored translucent sheet.

The design sheet 31 is constituted by a plastic or paper sheet that may be either transparent or translucent. This sheet may bear various patterns and pictures, or characters and symbols representative of what each operation key performs when operated.

FIG. 4B shows how the design sheet 31 is first mounted on the upper surface of the input device and how the sheet 31 is in turn topped with the transparent sheet 30.

In the setup of FIG. 4B, pictures and characters borne by the design sheet 31 appear on the upper surface of the input device. The transparent sheet 30 placed on top enhances appearance of the device.

When the transparent sheet 30 and design sheet 31 are both placed on the upper surface of the input device 1, they enhance appearance of the device, highlight the pleasurable device design, and offer protection against scratches and stains.

Needless to say, either the transparent sheet 30 or the design sheet 31 alone may be mounted, and the sheet still provides appearance enhancement and upper surface protection.

The design sheet 31 may be offered in numerous variations in terms of patterns and pictures. The user may switch sheet variations to enjoy different pictorial patterns in keeping with his or her preferences and mood swings.

The design sheet 31 may bear characters and symbols indicating in a clear and comprehensive manner the detailed functions assigned to each operating element. In FIG. 4B, for example, the design sheet 31 has characters "A", "B", "C" and "D" marked in correspondence with the operation keys 19, 20, 21 and 22 respectively. The sheet thus allows anyone to find at a glance that the operation keys 19, 20, 21 and 22 are used to execute operations A, B, C and D respectively.

In view of the fact that operative assignments to the operating elements vary depending on the apparatus targeted for input and on the application software in use, a dedicated design sheet 31 should preferably be provided for each target apparatus or application program. Each sheet may carry specific markings indicative of the assigned key operations applicable to the apparatus or program in question.

Every time a new target apparatus is hooked up for input or a new application program is installed for use, the user need only mount the applicable design sheet 31 to see clearly which operating elements execute which functions when operated.

Although the description above contains many specificities, these should not be construed as limiting the scope of the invention but as merely providing illustrations of the presently preferred embodiments of this invention. It is to be understood that changes and variations may be made without departing from the spirit or scope of the claims that follow. For example, the lever-type pointer 3 may be designed to be tiltable only lengthwise or crosswise.

The pointer 3 may be arranged to be depressible. The jog key 6 and shuttle key 7 may also be arranged to be depressible in addition to being rotated and pivoted.

The lever-type pointer 3 may be replaced by a shuttle ball-type operating element usually found at the bottom of a common mouse. That operating element if installed may be rotated in any direction by fingertips. Alternatively, the pointer 3 may be a touch-sensitive flat panel that detects points of contact with fingertips.

Obviously, numerous variations are conceivable about the overall shape of the input device 1, shape of the gripping part 2, layout locations of the gripping part 3 and other operating elements, and the number and the types of operating elements furnished.

To sum up, the input device according to the invention allows the user to operate the pointing part with fingertips while holding the gripping part by hand. The input device thus permits the same kinds of operation as those of a mouse without being moved about on a flat surface. This feature makes the input device easier to handle than the mouse.

Because one or multiple depressing parts are operable with the user's hand holding the gripping part, the same clicking operations as those of the mouse are available while the user is keeping his or her hand on the device. This also enhances the operability of the input device.

The pointing part is made tiltable at least crosswise and lengthwise. These motions of the pointing part provide a sufficiently wide range of pointing input functions. When made depressible, the pointing part provides additional operating functions that are implemented by the mouse, and still other functions.

The input device may also comprise a rotating part and/or a pivoting part furnished on top of the gripping part. The input device may further comprise either one or a plurality of operating parts so located as to be inaccessible by the user's fingers while the user's hand is holding the gripping part. These parts offer a still wider variety of input operations when manipulated.

Furthermore, the input device may comprise a sheet member which is mountable onto the upper surface of the input device and which bears pictorial patterns or characters as desired. When mounted on the upper surface, the sheet readily changes the appearance of the input device as desired by the user. With its markings indicative of the functional capabilities of the operating elements, the sheet improves the ease of operation of the input device. The inventive input device is connectable to various information processing and audio visual apparatuses. In different setups, the input device implements differently assigned functions with its operating elements depending on the application software in use and on the type of electronic equipment connected. Such diversely assigned functions of the operating elements are clearly presented to the user by means of a sheet member dedicated to each specific apparatus and program.

In addition, the input device may comprise a sheet member which is mountable onto the upper surface of the input device and which is either transparent or translucent. Such a sheet if furnished enhances appearance of the device and offers protection of the device surface against external damage.

The information processing apparatus according to another aspect of the invention comprises: an input device in an enclosure comprising a gripping part to be gripped by a user's hand, and a pointing part so located as to be operable by any of the user's fingers while the user's hand is holding the gripping part; and an information processing unit for processing information suitably in response to operating information which is input by operation of the pointing part included in the input device. As such, the inventive apparatus provides the user with an easy-to-operate, easy-to-master data input tool.

What is claimed is:

1. An input device, comprising:

a base including a front sloped portion shaped to receive a palm on a user's hand;

means for pointing located so as to be operable by a finger of the user's hand while the palm of the user's hand is resting on the base, wherein means for pointing is tiltable crosswise and lengthwise and depressible;

at least one means for operating located so as to be inaccessible by the finger's of the user's hand while the palm on the user's hand is resting on the front sloped portion of the base;

at least one means for depressing included at a rear portion of the base and configured to be accessible by the finger of the user's hand while a palm on the user's hand is resting on the front sloped portion of the base; and means for rotating furnished on top of the base, wherein means for rotating is able to be rotated clockwise and counterclockwise.

* * * * *